US009878572B2

(12) United States Patent
Stewart et al.

(10) Patent No.: US 9,878,572 B2
(45) Date of Patent: Jan. 30, 2018

(54) SECURITY DOCUMENT

(75) Inventors: Robert Laird Stewart, Wigton (GB); Steven Maude, Wigton (GB)

(73) Assignee: INNOVIA FILMS LIMITED, Wigton, Cumbria (GB)

( * ) Notice: Subject to any disclaimer, the term of this patent is extended or adjusted under 35 U.S.C. 154(b) by 303 days.

(21) Appl. No.: 13/386,816

(22) PCT Filed: Jul. 28, 2010

(86) PCT No.: PCT/GB2010/051238
§ 371 (c)(1),
(2), (4) Date: Apr. 4, 2012

(87) PCT Pub. No.: WO2011/012893
PCT Pub. Date: Feb. 3, 2011

(65) Prior Publication Data

US 2012/0187673 A1 Jul. 26, 2012

(30) Foreign Application Priority Data

Jul. 31, 2009 (GB) ..... 0913297.8

(51) Int. Cl.
*B42D 25/29* (2014.01)
*B42D 25/30* (2014.01)
(Continued)

(52) U.S. Cl.
CPC ..... *B42D 25/29* (2014.10); *B42D 25/30* (2014.10); *B42D 25/324* (2014.10);
(Continued)

(58) Field of Classification Search
CPC ..... B42D 1/00; B42D 19/00; B42D 15/00; B42D 25/29; B42D 25/00; B42D 25/30;
(Continued)

(56) References Cited

U.S. PATENT DOCUMENTS 3,749,006 A * 7/1973 Loose ..... 101/3.1
4,536,016 A 8/1985 Solomon et al.
(Continued)

FOREIGN PATENT DOCUMENTS

EP 1854641 11/2007
GB 2125337 3/1984
(Continued)

OTHER PUBLICATIONS

Notification of Transmittal of the International Search Report and the Written Opinion of the International Searching Authority of International Application No. PCT/GB2010/051238 dated Apr. 27, 2011.

(Continued)

*Primary Examiner* — Justin V Lewis
(74) *Attorney, Agent, or Firm* — Ping Wang; Andrews Kurth Kenyon LLP

(57) ABSTRACT

The present invention provides a security document and method of production thereof. The security document (10) comprises: a polymer substrate (12) having first (14) and second (22) surfaces; a security feature (16) formed in a region of at least one of said first and second surfaces of said polymer substrate; an opacifying layer (18, 24) formed on at least a portion of at least one of said first and second surfaces of said polymer substrate; a printed design formed on at least a portion of said opacifying layer; and wherein said security feature is formed at least prior to said printed design being formed.

26 Claims, 11 Drawing Sheets

(51) Int. Cl.

| | |
|---|---|
| *B42D 25/324* | (2014.01) |
| *B42D 25/425* | (2014.01) |
| *B42D 25/43* | (2014.01) |
| *B42D 25/445* | (2014.01) |
| *B42D 25/45* | (2014.01) |

(52) U.S. Cl.
CPC ..... *B42D 25/425* (2014.10); *B42D 25/43* (2014.10); *B42D 25/445* (2014.10); *B42D 25/45* (2014.10); *B42D 2033/08* (2013.01); *B42D 2033/24* (2013.01); *B42D 2035/30* (2013.01)

(58) Field of Classification Search
CPC .... B42D 25/324; B42D 25/425; B42D 25/43; B42D 25/445; B42D 25/45; B42D 2033/08; B42D 2033/24; B42D 2035/30
USPC .... 281/2, 3.1, 5; 283/61, 62, 67, 70, 72, 74, 283/79, 82, 85, 86, 94, 98, 101, 108, 109, 283/114, 901
See application file for complete search history.

(56) References Cited

U.S. PATENT DOCUMENTS

| | | | | |
|---|---|---|---|---|
| 6,273,473 | B1 | 8/2001 | Taylor et al. | |
| 2005/0225079 | A1* | 10/2005 | Woontner | G09F 3/0292 283/110 |
| 2008/0311317 | A1* | 12/2008 | Isherwood et al. | 283/82 |
| 2009/0102179 | A1* | 4/2009 | Lo | B42D 25/29 283/79 |
| 2010/0253061 | A1* | 10/2010 | Whiteman | B42D 25/425 283/85 |

FOREIGN PATENT DOCUMENTS

| | | | | |
|---|---|---|---|---|
| WO | 83/00659 | | 3/1983 | |
| WO | 98/13211 | | 4/1998 | |
| WO | 98/56596 | | 12/1998 | |
| WO | 00/18575 | | 4/2000 | |
| WO | 03/006261 | | 1/2003 | |
| WO | 03/101755 | | 12/2003 | |
| WO | WO 2006056892 | A2 * | 6/2006 | B29C 65/08 |
| WO | WO 2009050448 | A1 * | 4/2009 | B42D 25/425 |

OTHER PUBLICATIONS

Combined Search and Examination Report under Sections 17 & 18(3) of International Application No. PCT/GB2010/051238.
International Preliminary Report on Patentability and Written Opinion of the International Searching Authority of International Application No. PCT/GB2010/051238, filed Jul. 28, 2010, dated Feb. 9, 2012.

* cited by examiner

SECURITY DOCUMENT

This application is a national entry of PCT/GB2010/051238, Filed on Jul. 28, 2010, which claims priority of Great Britain Application No. 0913297.8, filed on Jul. 31, 2009. The entirety of all of the aforementioned applications is incorporated herein be reference.

FIELD

The present invention relates to a security document and a method of production thereof and particularly, but not exclusively, to a security document comprising a bank note and a method of production thereof.

BACKGROUND

Polymer films are increasingly being used as substrates in fields where security, authentication, identification and anti-counterfeiting are important. Polymer-based products in such areas include for example bank notes, important documents (e.g. ID materials such as for example passports and land title, share and educational certificates), films for packaging high-value goods for anti-counterfeiting purposes, and security cards.

Polymer-based secure materials have advantages in terms of security, functionality, durability, cost-effectiveness, cleanliness, processability and environmental considerations. Perhaps the most notable amongst these is the security advantage. Paper-based bank notes, for example, can be relatively easy to copy, and there is lower occurrence of counterfeits in countries with polymer-based bank notes compared to paper-based bank notes. Polymer-based bank notes are also longer-lasting and less-easily torn.

Security materials based on polymer films are amenable to the incorporation of a variety of visible and hidden security features. Since the introduction of the first polymer bank notes approximately 25 years ago, security features have included optically variable devices (OVD), opacification features, printed security features, security threads, embossings, transparent windows and diffraction gratings. Aside from complicated security features there is also the more immediate advantage that the high temperatures used in copying machines will often cause melting or distortion of polymer base-material if counterfeiters attempt simply to copy secure materials (e.g. bank notes) using such machines.

The basic polymer substrate for such bank notes is processed using some, or all, of the following steps to arrive at the finished product:

1. Opacifying—two layers of ink (usually white) are applied to each side of the note, except for a region that is deliberately left clear, i.e. as a transparent window;
2. Sheeting—the substrate is cut into sheets suitable for the printing press;
3. Printing—one or more of traditional offset, intaglio and letterpress printing processes may be used; and
4. Overcoating—notes are coated with a protective varnish.

In-film features such as embossings, etchings, etc. are often incorporated into transparent and/or partially transparent windows in otherwise substantially opaque security documents.

As noted above, an intaglio printing process is a known method of providing printed features on such security documents. A window has become an important feature of security document substrates and is often enhanced by embossing numbers, text or images directly into the bare window. Where a security document comprises an opacified region and a window having such embossings, the embossings can be formed as part of the intaglio process. The heat and pressure of the intaglio process is such that it allows for embossing simultaneously with intaglio printing.

Current processes suffer limitations in that the embossing is often the final process and therefore cannot be integrated with opacification and/or offset printing. Further, in current processes, the embossings are effectively a free fringe benefit of the intaglio process, but security document printers charge the substrate suppliers for this feature as a separate security document feature.

Whilst the above described security documents and methods of production thereof offer features of interest, it is desirable to provide a security document and method of production thereof which offers improved properties, and thus the present invention seeks to provide for a security document and method of production thereof having advantages over known such security documents and methods of production thereof.

BRIEF DESCRIPTION OF THE DRAWINGS

The present invention is described further hereinafter, by way of example only, with reference to the accompanying drawings in which.

DETAILED DESCRIPTION

Figure 1A:
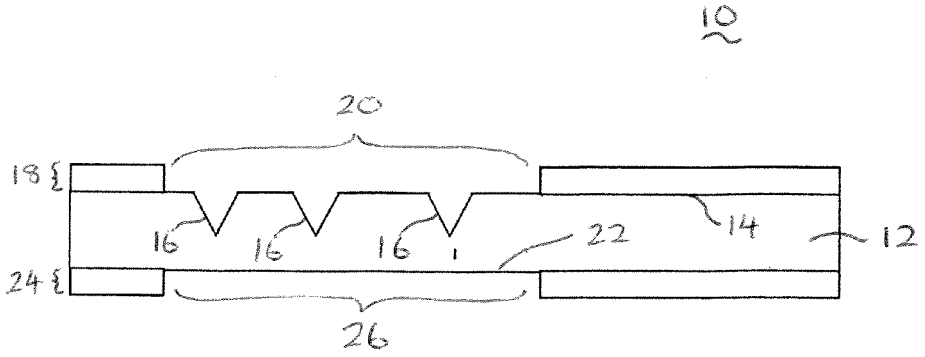
FIG. 1*a* illustrates a schematic side elevation of a security document marked with a security feature and having opacifying layers applied thereto in a first embodiment.

According to an aspect of the present invention, there is provided a method of producing a security document, comprising: forming a polymer substrate having first and second surfaces; forming a security feature on a region of at least one of said first and second surfaces of said polymer substrate; forming an opacifying layer on at least a portion of at least one of said first and second surfaces of said polymer substrate; printing a design on said opacifying layer; wherein said security feature forming step occurs at least prior to said printing step, wherein said security feature forming step occurs at least prior to said opacifying layer forming step, and wherein said security feature forming step comprises embossing of said security feature in said region of at least one of said first and second surfaces of said polymer substrate and/or etching of said security feature in said region of at least one of said first and second surfaces of said polymer substrate.

It will be understood from the above discussion of conventional techniques that embossing/etching is currently carried out at least after opacification. By reversing this process, i.e. embossing/etching the films during an earlier stage of the manufacturing process (at least prior to the printing step and the step of forming the opacifying layer), the present invention offers the advantage that it is possible to generate markings/features that are integrated with subsequent printed layers. Thus, any marking/feature can be integrated across two or more layers, thereby increasing the difficulty involved in copying. For instance, in a security document formed by the method of the present invention and which incorporates a window in which is formed a security feature, and where the security feature also extends under an opacification layer, the common method of counterfeiting polymer security documents having a window, i.e. cutting a hole in the counterfeit security document and forming a window using an adhered film patch, would be prevented because the security feature extends under the opacification layer. it will be appreciated that the features of a security document formed according to a method of the present invention will have greater security and appeal as these features can be combined with print layers to produce marks that could only be made during the manufacturing process. Moreover, the opacifying layer will be of variable thickness over the embossing or etching, giving rise to differential visual effects in the opacifying layer.

Conveniently, said security feature forming step occurs during a slitting step of a film from a web, said film forming said polymer substrate.

If required, said region of at least one of said first and second surfaces of said polymer substrate may be in register with said at least a portion of at least one of said first and second surfaces of said polymer substrate having an opacifying layer formed thereon.

Further, said region of at least one of said first and second surfaces of said polymer substrate may be partially overlapped by said at least a portion of at least one of said first and second surfaces of said polymer substrate having an opacifying layer formed thereon.

In particular, said opacifying layer may be formed over the entire first and/or second surface of said polymer substrate.

Additionally, said region of at least one of said first and second surfaces of said polymer substrate may not be overlapped by said at least a portion of at least one of said first and second surfaces of said polymer substrate having an opacifying layer formed thereon.

The security feature forming step comprises embossing of said security feature in said region of at least one of said first and second surfaces of said polymer substrate and/or etching of said security feature in said region of at least one of said first and second surfaces of said polymer substrate. In particular, an ultrasonic embossing method and/or laser etching method are preferable. Ultrasonic embossing is advantageous in that it can be carried out at high speeds. Additionally, an embossing head in such a process is self cleaning, thereby preventing accumulation of debris. The embossing head is also small, energy efficient and can be integrated into a web based process.

The advantages of laser etching are that it can be carried out at high speed, the etching can be single or double sided, it results in little distortion of the film forming the substrate, no tooling is required for different jobs (since patterns can be set using software), and depths within a single pattern can be varied. Laser etching also offers an advantage over ultrasonic embossing in that it can allow for finer patterning than ultrasonic embossing. It does, however, suffer a disadvantage compared with ultrasonic embossing in that, whilst offering a high speed of marking, this is not as fast as is possible with ultrasonic embossing.

Further, the lasers envisaged to be used to carry out laser etching in the present invention (CO2 lasers) are cheap, efficient and reliable. Of course, other laser types may also be used.

As noted above, both ultrasonic embossing and laser etching have distinct advantages. Ultrasonic embossing equipment is cheap and simple; the process is not complex and is robust. However, tooling costs are potentially prohibitive between jobs and laser etching is capable of finer features without distorting the base film. Ultrasonic embossing does have the advantage that the speed of the process is not related to the complexity of the patterns being generated. Whilst laser etching scribes out patterns and does so at very high speeds (>15 m/s), a very complex pattern can be too time-consuming for a moving web as may be required to perform the method of the present invention. Another advantage of such techniques is the ability to control the quantum (e.g. height) of debossment, embossment or etching, as the case may be; greater embossment heights for example giving more evident visual effects in the opacifying layer. Aside from process advantages when compared with other techniques, the concept of putting in-film features into films at an earlier stage in the production process also has a number of design advantages. A number of design based features can be generated that take advantage of this and these are described further below in the specific description.

In the context of the present invention, the term opacifying layer may include at least one of: actual opacifying layers, white or otherwise; and/or offset, screen printed, colored gravure and/or foil patches.

Preferably, said polymer substrate is transparent. Further, said polymer substrate may be formed from a polymer film which is, preferably, a biaxially oriented propylene polymer (BOPP) film.

If required, the security feature may be at least one of: machine readable; and human readable.

According to another aspect of the present invention, there is proved a security document, comprising: a polymer substrate having first and second surfaces; a security feature formed in a region of at least one of said first and second surfaces of said polymer substrate; an opacifying layer formed on at least a portion of at least one of said first and second surfaces of said polymer substrate; a printed design formed on at least a portion of said opacifying layer; wherein said security feature is formed at least prior to said printed design being formed, wherein said security feature is formed at least prior to said opacifying layer being formed, and wherein said security feature is formed by embossing of said security feature in said region of at least one of said first and second surfaces of said polymer substrate and/or etching of said security feature in said region of at least one of said first and second surfaces of said polymer substrate.

In the following description, a number of design based features that are generated as a result of adding in-film features at an earlier stage in the production process are described (i.e. where the in-film features are formed prior to an intaglio printing step). In each case, the marking method to form the in-film security feature (e.g. laser etching and/or ultrasonic embossing) can be performed on one or both sides of the film. Further, whilst variations in opacification layers are only illustrated in one dimension in the figures, they can just as easily be in two dimensions.

The term opacifying layer can apply to an actual white opacifying layer and/or to offset, screen printed, colored gravure or even foil patches. Also, when referring to markings formed in the substrate to form a security feature, these markings may be formed by laser etching and/or ultrasonic embossing, or any other suitable marking method.

In the embodiments described hereinafter, a substrate forming part of a described security document is preferably a biaxially oriented propylene polymer film.

Figure 1B:
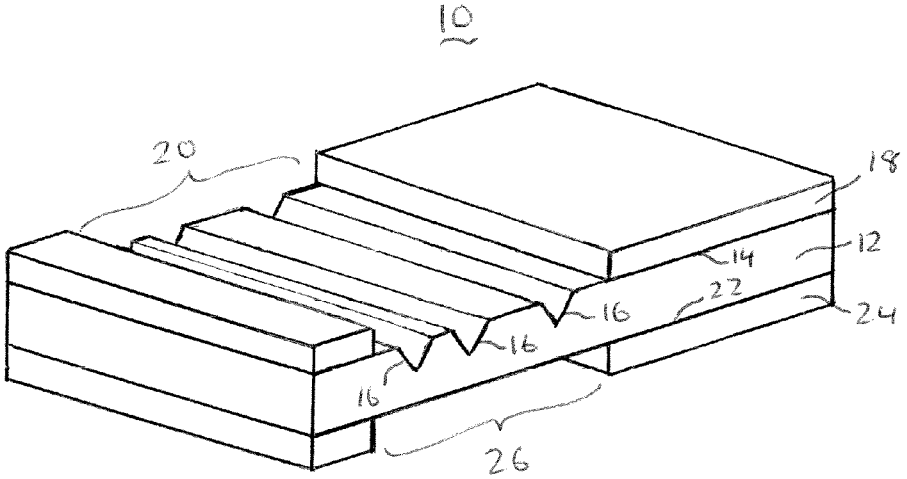
FIG. 1*b* illustrates a schematic perspective view of the security document of FIG. 1*a;*

FIGS. 1*a* and 1*b* illustrate a security document 10 which comprises a substrate 12, having formed on a region of a first surface 14 thereof a plurality of markings 16 arranged to form a security feature of the security document 10. A portion of the first surface 14 also h as an opacifying layer 18 formed thereon. The opacifying layer 18 is formed with a gap 20 therein, and said gap 20 is located above the plurality of markings 16. The substrate 12 has, on a portion of a second surface 22 thereof, an opacifying layer 24 formed thereon, with a gap 26 being formed in said opacifying layer 24. The gap 26 is located under the plurality of markings 16.

The arrangement of the gaps 20, 26 formed in the respective opacifying layers 18, 24 effectively forms a window in the security document. As will be appreciated, this window is aligned with the plurality of markings 16 (see FIG. 1*b*) and a security feature formed from said plurality of markings 16 can be viewed easily through said window, i.e. there is not integration between the opacifying layers 18, 24 and the plurality of markings 16.

Figure 2:
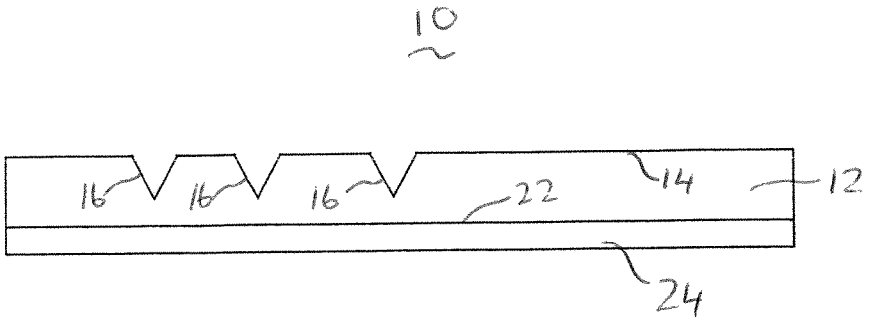
FIG. 2 illustrates a schematic side elevation of a security document marked with a security feature and having an opacifying layer applied thereto in a second embodiment.

In FIG. 2, there is illustrated a security document 10 in which an opacifying layer is applied to only one surface of substrate 12. The features illustrated in FIG. 2 which correspond to features already described in relation to FIG. 1 are denoted by like reference numerals.

The opacifying layer 24 is formed over the entire second surface 22 of the substrate 12, while the first surface 14 of the substrate 12 is uncoated. The plurality of markings 16 forming the security feature can be thought of as being in a "half-window". Such an arrangement provides for a form of integrating the plurality of markings 16 with an opacifying layer (i.e. underlying opacifying layer 24).

In this embodiment, the visibility of the plurality of markings 16 will vary according to a viewing angle, because the gloss of the untreated first surface 14 will differ from that of the first surface in the region of the plurality of markings 16. Also, the appearance of the first surface in the region of the plurality of markings 16 will differ depending on if viewed in transmission or reflection, and on the depth and density of the plurality of markings 16.

Figure 3:
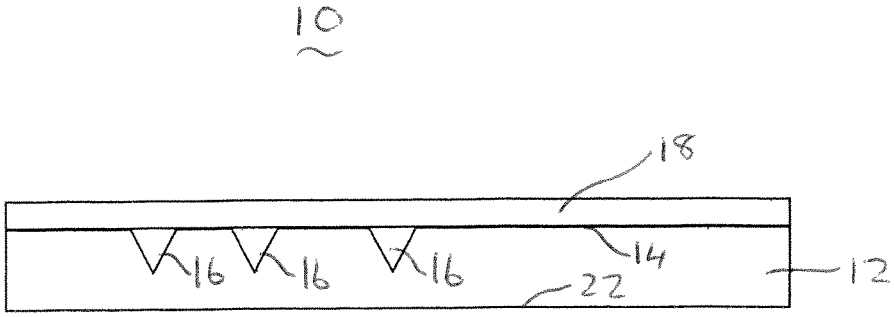
FIG. 3 illustrates a schematic side elevation of a security document marked with a security feature and having an opacifying layer applied thereto in a third embodiment.

FIG. 3 illustrates a security document 10 in which an opacifying layer is applied to only one surface of substrate 12. The features illustrated in FIG. 3 which correspond to features already described above are denoted by like reference numerals.

The opacifying layer 18 is formed over the entire first surface 14 of the substrate 12, while the second surface of the substrate 22 is uncoated. The plurality of markings 16 forming the security feature can be thought of as being in a "reverse half-window". Such an arrangement provides for a simple form of integrating the plurality of markings 16 with an opacifying layer (i.e. overlying opacifying layer 18). In this embodiment, the printing of an opacifying layer 18 into the plurality of markings 16 produces a different result to that achieved in the previously described embodiments. The visual impact of the appearance of the security feature formed from the plurality of markings 16 is reduced compared with the previously described embodiments resulting in a more subtle marking system.

Figure 4:
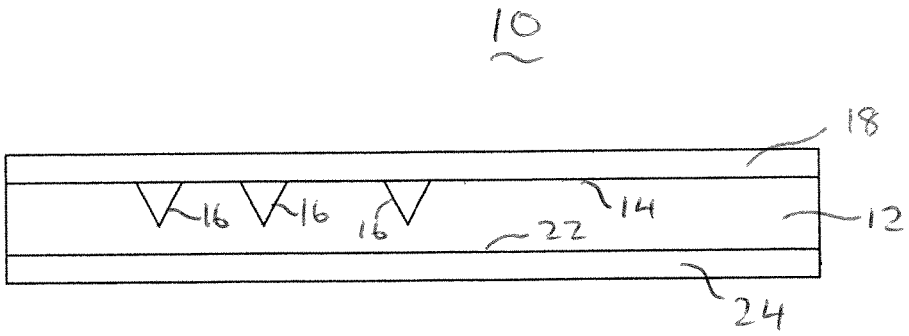
FIG. 4 illustrates a schematic side elevation of a security document marked with a security feature and having opacifying layers applied thereto in a fourth embodiment.

In FIG. 4, there is illustrated a security document 10 in which opacifying layers are applied to both surfaces of substrate 12. The features illustrated in FIG. 4 which correspond to features already described above are denoted by like reference numerals.

A first opacifying layer 18 is formed over the entire first surface 14 of the substrate 12, and a second opacifying layer 24 is fainted on the entire second surface 22 of the substrate 12. The plurality of markings 16 forming the security feature can be thought of as being hidden markings, i.e. the plurality of markings 16 are hidden by the two opacifying layers 18, 24 and are visible only in transmission.

Figure 5:
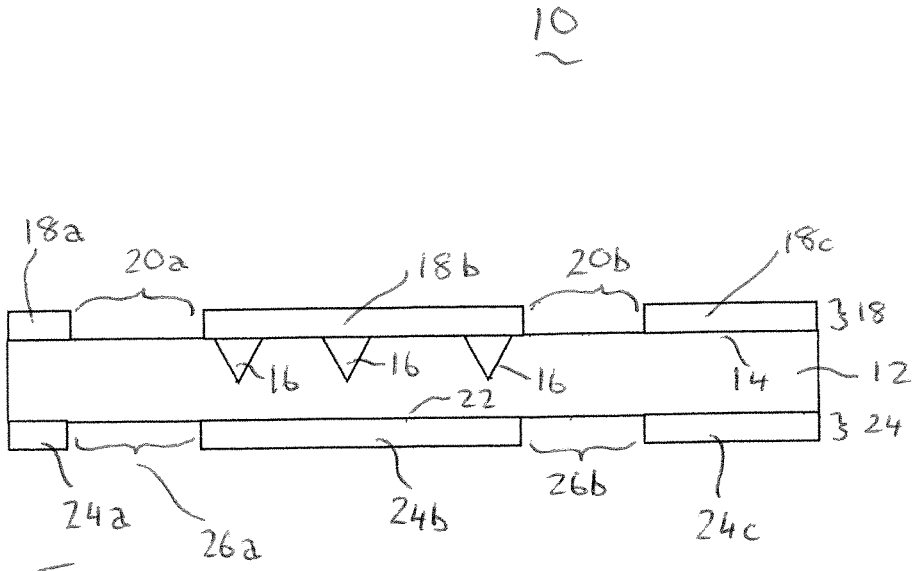
FIG. 5 illustrates a schematic side elevation of a security document marked with a security feature and having opacifying layers applied thereto in a fifth embodiment.

FIG. 5 illustrates a security document 10 in which opacifying layers are applied to both surfaces of substrate 12 and which include window regions. The features illustrated in FIG. 5 which correspond to features already described above are denoted by like reference numerals.

A portion of the first surface 14 has a first opacifying layer 18 formed thereon. The first opacifying layer 18 is formed with two gaps 20*a*, 20*b* therein, thereby separating the first opacifying layer 18 into three regions 18*a*, 18*b*, 18*c*. The substrate 12 has, on a portion of a second surface 22 thereof, a second opacifying layer 24 formed thereon, with two gaps 26*a*, 26*b* being formed in said second opacifying layer 24. These gaps 26*a*, 26*b* separate the second opacifying layer 24 into three regions 24*a*, 24*b*, 24*c*.

A first region 18*a* of the first opacifying layer 18 is formed so as to be located substantially directly opposite a first region 24*a* of the second opacifying layer 24. Similarly, a second region 18*b* of the first opacifying layer 18 is formed so as to be located substantially directly opposite a second region 24*b* of the second opacifying layer 24, and a third region 18*c* of the first opacifying layer 18 is formed so as to be located substantially directly opposite a third region 24*c* of the second opacifying layer 24.

The plurality of markings 16 are formed in the region of substrate 12 which lies between the second region 18*b* of the first opacifying layer 18 and the second region 24*b* of the second opacifying layer 24.

Further, first gap 20*a* formed between first and second regions 18*a*, 18*b* of the first opacifying layer 18 is located substantially directly opposite first gap 26*a* formed between first and second regions 24*a*, 24*b* of the second opacifying layer 24. Similarly second gap 20*b* formed between second and third regions 18*b*, 18*c* of the first opacifying layer 18 is located substantially directly opposite second gap 26*b* formed between second and third regions 24*b*, 24*c* of the second opacifying layer 24.

The arrangement of the pairs of gaps 20*a*, 26*a* and 20*b*, 26*b* of the respective first and second opacifying layers 18, 24 forms two windows in the security document. As will be appreciated, an "island of opacification" is formed by second region 18*b* of the first opacifying layer 18 and the second region 24*b* of the second opacifying layer 24, and it is with this "island of opacification" that the plurality of markings 16 are aligned, i.e. the plurality of markings 16 are hidden in this "island of opacification".

Figure 6:
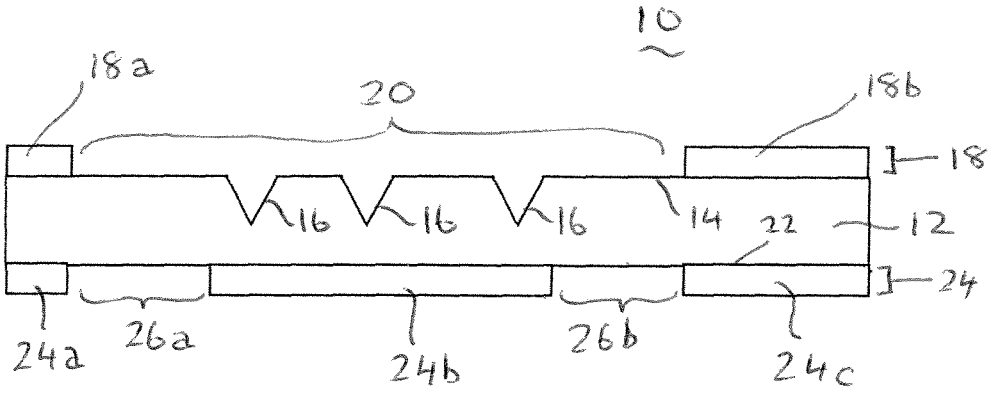
FIG. 6 illustrates a schematic side elevation of a security document marked with a security feature and having opacifying layers applied thereto in a sixth embodiment.

In FIG. 6, there is illustrated a security document 10 in which opacifying layers are applied to both surfaces of substrate 12 and which include window regions. The features illustrated in FIG. 6 which correspond to features already described above are denoted by like reference numerals.

A portion of the first surface 14 has a first opacifying layer 18 formed thereon. The first opacifying layer 18 is formed with a gap 20 therein, thereby separating the first opacifying layer 18 into two separate regions 18*a*, 18*b*. The gap 20 extends over a part of the first surface 14 of the substrate 12 including a region thereof where the plurality of markings 16 is located.

The substrate 12 has, on a portion of a second surface 22 thereof, a second opacifying layer 24 formed thereon, with two gaps 26*a*, 26*b* being formed in said second opacifying layer 24. These gaps 26*a*, 26*b* separate the second opacifying layer 24 into three separate regions 24*a*, 24*b*, 24*c*.

A first region 18*a* of the first opacifying layer 18 is formed so as to be located substantially directly opposite a first region 24*a* of the second opacifying layer 24. Similarly, a second region 18*b* of the first opacifying layer 18 is formed so as to be located substantially directly opposite a third region 24*c* of the second opacifying layer 24.

The plurality of markings 16 are formed in the region of substrate 12 which lies over a second region 24*b* of the second opacifying layer 24.

The arrangement of the pairs of gaps 26*a*, 26*b* formed in the second opacifying layer 24 in relation to the gap 20 formed in the first opacifying layer 18 and the plurality of markings 16 results in a "half-window island of opacification", i.e. the plurality of markings 16 forming the security feature can be thought of as being located within this "half-window island of opacification". Such an arrangement provides for a form of integrating the plurality of markings 16 with an opacifying layer (i.e. underlying opacifying layer 24).

Figure 7:
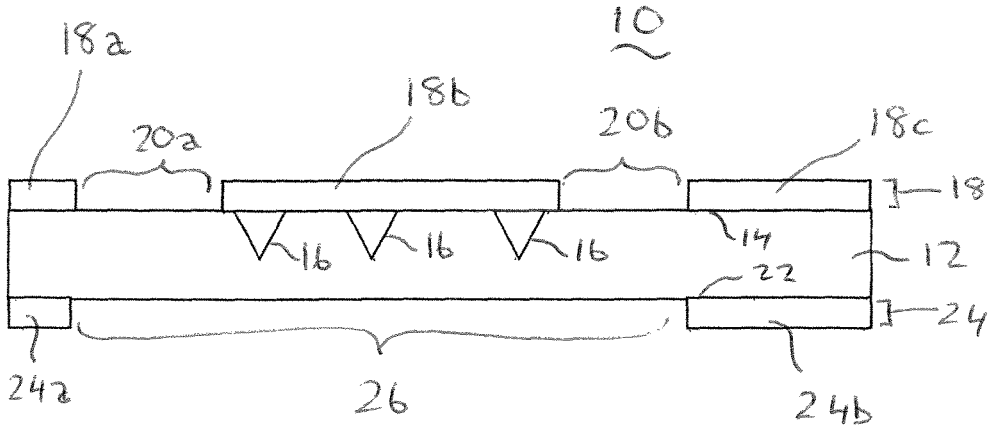
FIG. 7 illustrates a schematic side elevation of a security document marked with a security feature and having opacifying layers applied thereto in a seventh embodiment.

In this embodiment, the visibility of the plurality of markings 16 will vary according to a viewing angle, because the gloss of the untreated first surface 14 (i.e. in the region formed by gap 20) will differ from that of the first surface in the region of the plurality of markings 16 and where the first opacifying layer 18 is formed. Also, the appearance of the first surface 14 in the region of the plurality of markings 16 will differ depending on if viewed in transmission or reflection, and on the depth and density of the plurality of markings 16. FIG. 7 illustrates an embodiment which is similar to that of FIG. 6, but in which the arrangement is reversed.

In this figure, there is illustrated a security document 10 in which opacifying layers are applied to both surfaces of substrate 12 and which include window regions. The features illustrated in FIG. 7 which correspond to features already described above are denoted by like reference numerals.

A portion of the first surface 14 has a first opacifying layer 18 formed thereon. The first opacifying layer 18 is formed with two gaps 20*a*, 20*b* therein, thereby separating the first opacifying layer 18 into three regions 18*a*, 18*b*, 18*c*.

The substrate 12 has, on a portion of a second surface 22 thereof, a second opacifying layer 24 formed thereon, with a gap 26 being formed in said second opacifying layer 24. This gap 26 separates the second opacifying layer 24 into two regions 24*a*, 24*b*.

A first region 18*a* of the first opacifying layer 18 is formed so as to be located substantially directly opposite a first region 24*a* of the second opacifying layer 24. Similarly, a third region 18*c* of the first opacifying layer 18 is formed so as to be located substantially directly opposite a second region 24*b* of the second opacifying layer 24.

The plurality of markings 16 are formed in the region of substrate 12 which lies under a second region 18*b* of the first opacifying layer 18.

The arrangement of the pairs of gaps 20*a*, 20*b* formed in the first opacifying layer 18 in relation to the gap 26 formed in the second opacifying layer 24 and the plurality of markings 16 results in a "reverse half-window island of opacification", i.e. the plurality of markings 16 forming the security feature can be thought of as being located within this "reverse half-window island of opacification". Such an arrangement provides for a form of integrating the plurality of markings 16 with an opacifying layer (i.e. overlying opacifying layer 18). in this embodiment, the opacifying layer 18 is printed into the plurality of markings 16 and, as a result, the visual impact of the appearance of the security feature formed from the plurality of markings 16 is reduced compared with the some of the previously described embodiments, thereby resulting in a more subtle marking system.

Figure 8A:
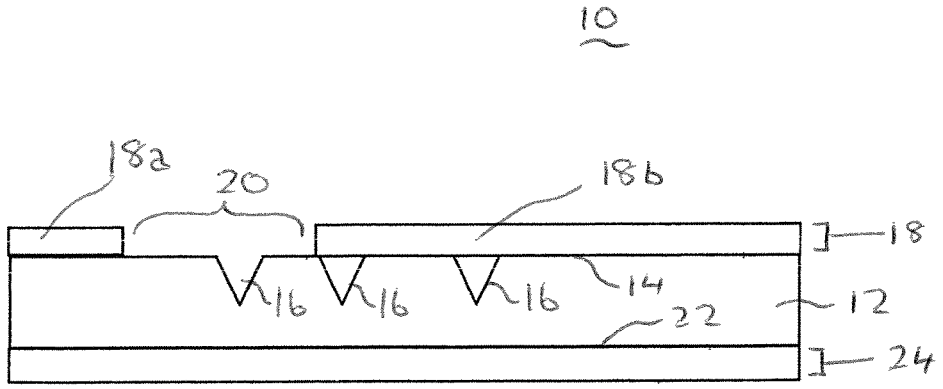
FIG. 8*a* illustrates a schematic side elevation of a security document marked with a security feature and having opacifying layers applied thereto in an eighth embodiment.

FIG. 8*a* illustrates a security document 10 which comprises a substrate 12, having formed on a region of a first surface 14 thereof a plurality of markings 16 arranged to form a security feature of the security document 10. A portion of the first surface 14 also has a first opacifying layer 18 formed thereon. The opacifying layer 18 is formed with a gap 20 therein, which effectively separates said first opacifying layer 18 into first and second regions 18*a*, 18*b*. The gap 20 is located above at least one of the plurality of markings 16. The substrate 12 has formed on an entire second surface 22 thereof a second opacifying layer 24.

The arrangement of the gap 20 formed in the first opacifying layer 18 in relation to the plurality of markings 16 such that at least one of the plurality of markings 16 is uncovered, whilst the remainder are overlapped by a portion of the first opacifying layer 18, results in a "half-window/half-hidden" arrangement. Thus, by covering a portion of the plurality of markings 16 with an opacifying layer, and the remaining at least one of the plurality of markings 16 being in a half-window, an effect is achieved whereby the visibility of a section of the plurality of markings 16 (i.e. the uncovered part) will vary with viewing angle due to gloss differences as described above in relation to the embodiments illustrated in FIGS. 2 and 3. However, all (i.e. both the covered and uncovered parts) of the said plurality of markings 16 may be visible in transmission.

Figure 8B:
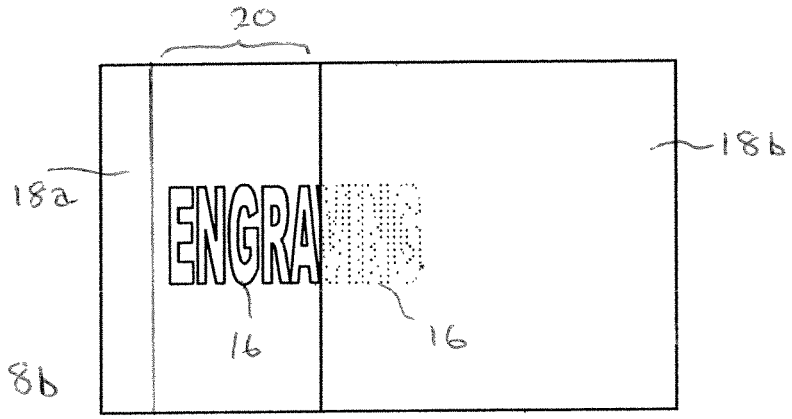
FIG. 8*b* illustrates a plan view of the security document of FIG. 8*a* when viewed in transmission.
Figure 8C:
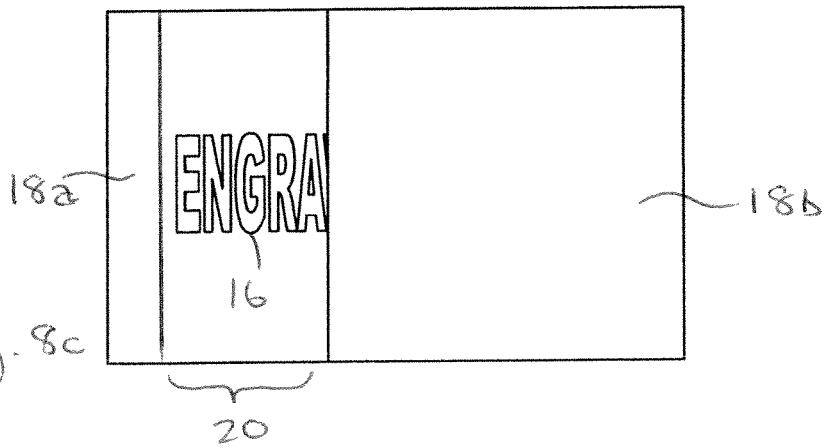
FIG. 8*c* illustrates a plan view of the security document of FIG. 8*a* when viewed in reflection.
Figure 9A:
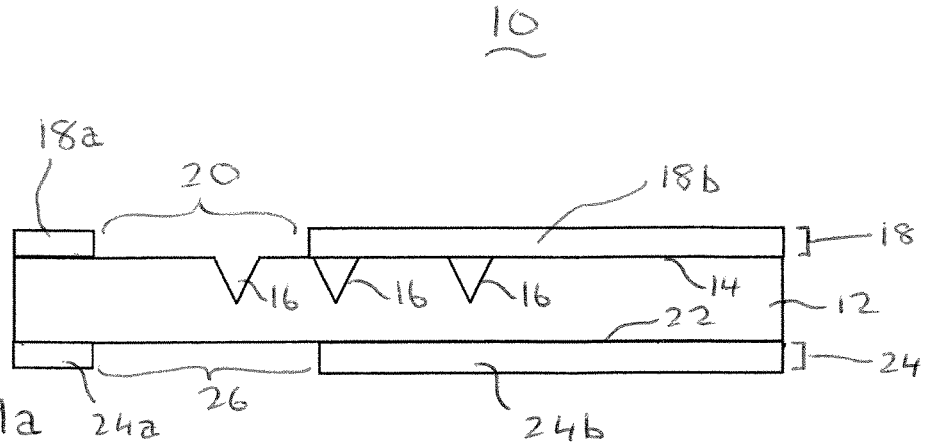
FIG. 9*a* illustrates a schematic side elevation of a security document marked with a security feature and having opacifying layers applied thereto in a ninth embodiment.

FIGS. 8*b* and 8*c* illustrate the security document 10 of FIG. 8*a* when viewed in transmission and reflection respectively. As will be appreciated, in transmission, the portion of the plurality of markings 16 which is covered by a portion of the first opacifying layer 18 is visible through the opacifying layer 18. FIG. 9*a* illustrates a security document 10 which comprises a substrate 12, having formed on a region of a first surface 14 thereof a plurality of markings 16 arranged to form a security feature of the security document 10. A portion of the first surface 14 also has a first opacifying layer 18 formed thereon. The first opacifying layer 18 is formed with a gap 20 therein, which effectively separates said first opacifying layer 18 into first and second regions 18*a*, 18*b*. The gap 20 is located above at least one of the plurality of markings 16.

The substrate 12 also has formed on a portion of the second surface 22 thereof a second opacifying layer 24. The second opacifying layer 24 is also formed with a gap 26 therein which effectively separates said second opacifying layer 24 into first and second regions 24*a*, 24*b*. The gap 26 is located under at least one of the plurality of markings 16, and substantially directly opposite gap 20.

A first region 18*a* of the first opacifying layer 18 is formed so as to be located substantially directly opposite a first region 24*a* of the second opacifying layer 24. Similarly, a second region 18*b* of the first opacifying layer 18 is formed so as to be located substantially directly opposite a second region 24*b* of the second opacifying layer 24.

The arrangement of the gaps 20, 26 formed in the respective first and second opacifying layers 18, 24 effectively forms a window in the security document. As will be appreciated, at least one of the plurality of markings 16 is aligned with the window, with the remainder of the plurality of markings 16 being concealed between second region 18*b* of the first opacifying layer 18 and second region 24*b* of the second opacifying layer 24. Thus, the security feature formed from said plurality of markings 16 effectively crosses from the window to a fully concealed region.

Therefore, by covering a portion of the plurality of markings 16 with an opacifying layer, and with the remaining at least one of the plurality of markings 16 being in a window, an effect is achieved whereby the visibility of a section of the plurality of markings 16 (i.e. the uncovered part) will vary with viewing angle due to gloss differences as described above in relation to the embodiments illustrated in FIGS. 2, 3 and 8. However, all (i.e. both the covered and uncovered parts) of the said plurality of markings 16 may be visible in transmission.

Figure 9B:
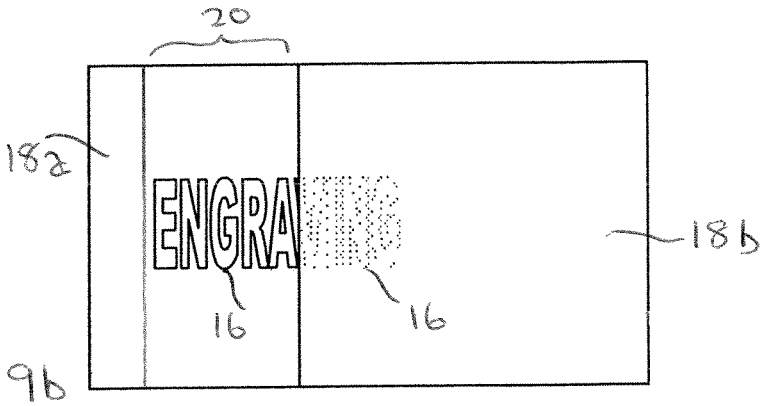
FIG. 9*b* illustrates a plan view of the security document of FIG. 9*a* when viewed in transmission.
Figure 9C:
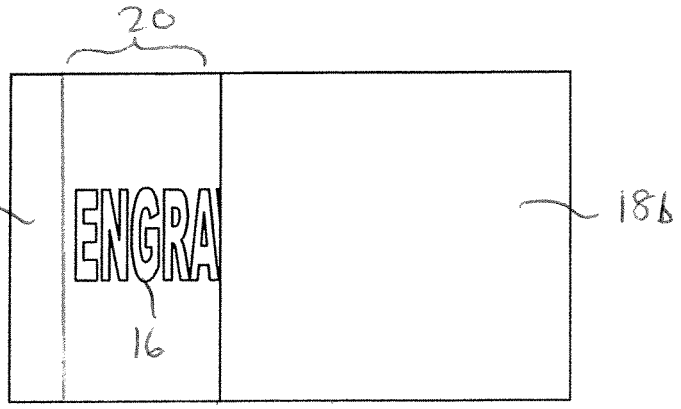
FIG. 9*c* illustrates a plan view of the security document of FIG. 9*a* when viewed in reflection.

FIGS. 9*b* and 9*c* illustrate the security document 10 of FIG. 9*a* when viewed in transmission and reflection respectively. As will be appreciated, in transmission, the portion of the plurality of markings 16 which is covered by a portion of the first opacifying layer 18 is visible through opacifying layers 18, 24.

Figure 10A:
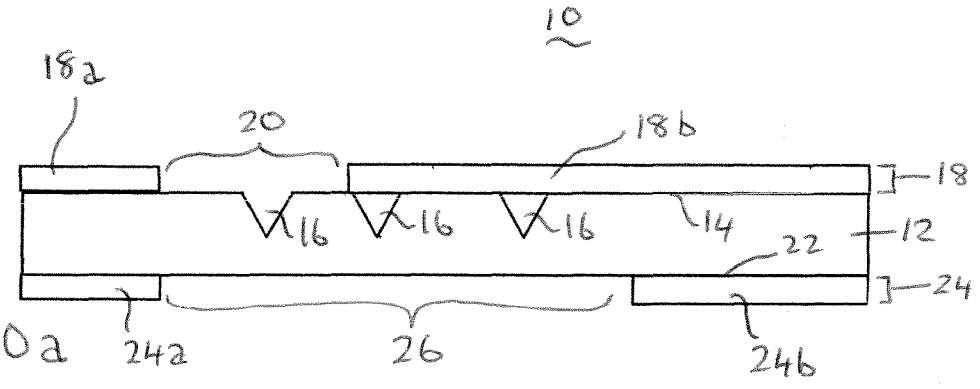
FIG. 10*a* illustrates a schematic side elevation of a security document marked with a security feature and having opacifying layers applied thereto in a tenth embodiment.

However, the windows located in the first and second opacifying layers 18, 24 need not be symmetrical. As illustrated in FIG. 10*a*, the gap 20 in the first opacifying layer 18 is smaller than the gap 26 in the second opacifying layer 24. Thus, whilst gap 20 is located above at least one of the plurality of markings 16 (with the remainder of the plurality of markings having second opacifying region 18*b* of first opacifying layer 18 located thereover to form a partially hidden security feature), the gap 26 is arranged under all of said plurality of markings 16.

As will be appreciated, the level of visibility of the hidden portion of the security feature differs from that of the embodiment described in relation to FIG. 9 due to the lack of an opacifying layer under/behind the hidden portion.

Figure 10B:
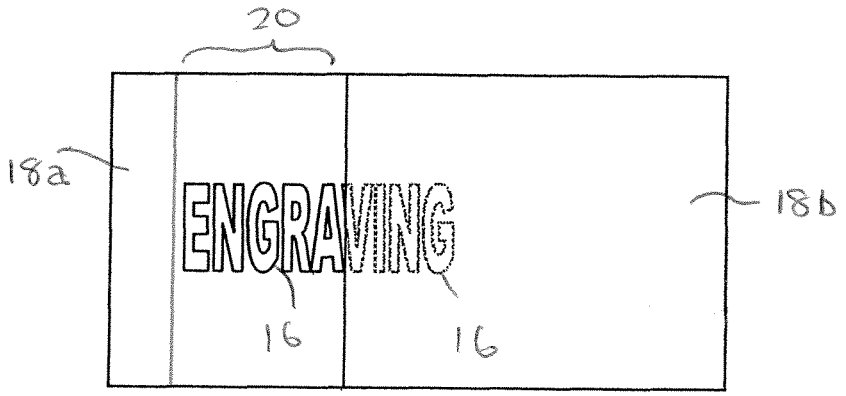
FIG. 10*b* illustrates a plan view of the security document of FIG. 10*a* when viewed in transmission.
Figure 10C:
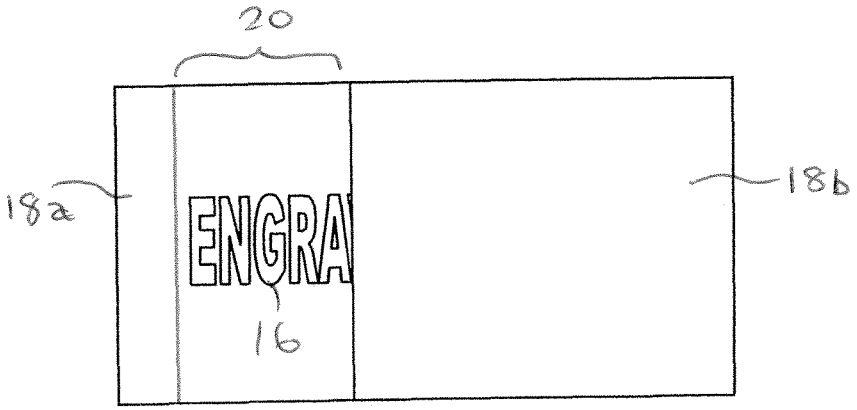
FIG. 10*c* illustrates a plan view of the security document of FIG. 10*a* when viewed in reflection.

FIGS. 10*b* and 10*c* illustrate the security document 10 of FIG. 10*a* when viewed in transmission and reflection respectively. As will be appreciated, in transmission, the portion of the plurality of markings 16 which is covered by a portion of the first opacifying layer 18 is visible through opacifying layer 18.

Figure 11A:
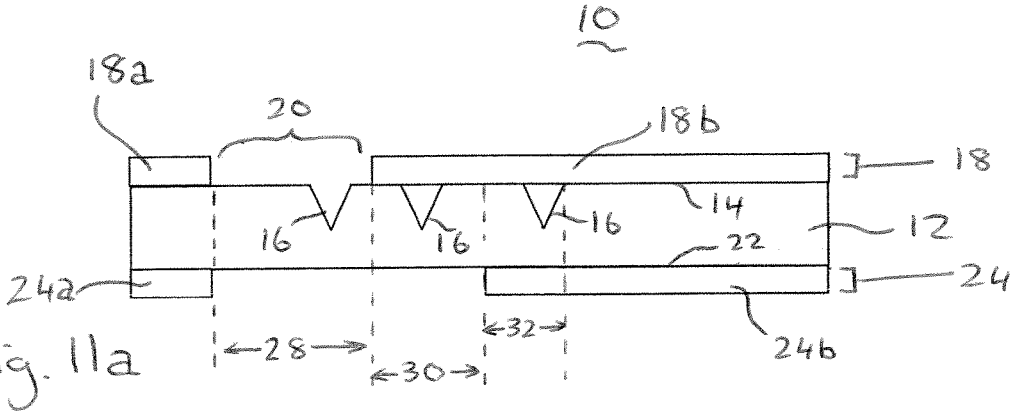
FIG. 11*a* illustrates a schematic side elevation of a security document marked with a security feature and having opacifying layers applied thereto in an eleventh embodiment.
Figure 11B:
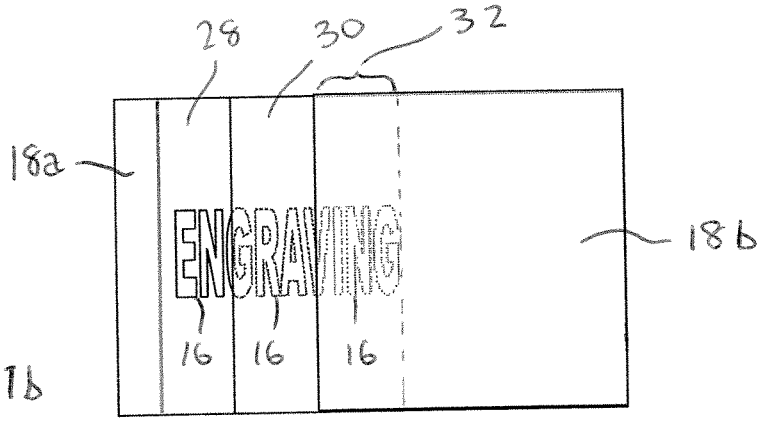
FIG. 11*b* illustrates a plan view of the security document of FIG. 11*a* when viewed in transmission.
Figure 11C:
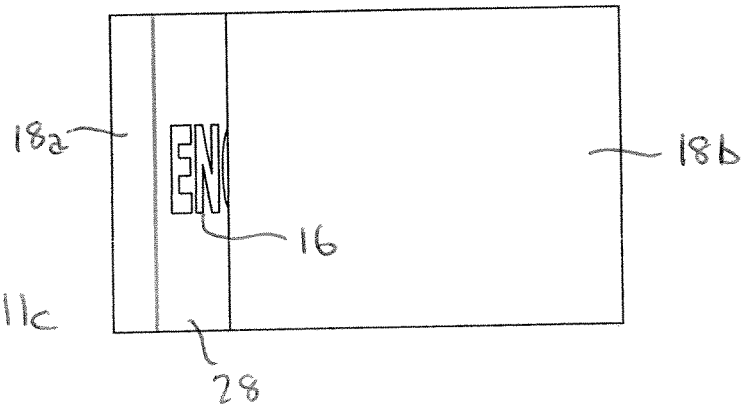
FIG. 11*c* illustrates a plan view of the security document of FIG. 11*a* when viewed in reflection.

The embodiment illustrated in FIGS. 11*a* to 11*c* modifies the arrangement of FIGS. 10*a* to 10*c* still further. As illustrated in FIG. 11*a*, the gap 20 in the first opacifying layer 18 is smaller than the gap 26 in the second opacifying layer 24. Gap 20 is located above a first region 28 of the plurality of markings 16 (with second and third regions 30, 32 of the plurality of markings having second opacifying region 18*b* of first opacifying layer 18 located thereover). Gap 26 in the second opacifying layer 24 is located under both the first and second regions 28, of said plurality of markings 16. Second opacifying region 24*b* of second opacifying layer 24 extends under the third region 32 of said plurality of markings 16.

As will be appreciated, the level of visibility of the various regions of the plurality of markings (with the second and third regions forming partially hidden and hidden portions respectively of the security feature) will differ due to the fact that there are no opacifying layers above/below the first region 28, there is only an opacifying layer above the second region 30, and there are opacifying layers both above and below the third region 32.

FIGS. 11*b* and 11*c* illustrate the security document 10 of FIG. 11*a* when viewed in transmission and reflection respectively. As will be appreciated, in transmission, there will be three levels of visibility of the security feature resulting from the differing levels of visibility of the three regions of the plurality of markings 16. The proportions of the security feature that will be visible when the security document 10 is viewed in reflection will differ depending on the side of the note being observed. The full security feature, however, will only be visible when the security document is viewed in transmission.

The embodiment illustrated in FIGS. 12*a* to 12*e* modifies the arrangement of FIGS. 11*a* to 11*c* still further. In this embodiment, the arrangement of gaps 20, 26 is reversed compared with the embodiment illustrated in FIGS. 11*a* to 11*c*. In this instance, the gap 20 is larger than the gap 26.

Gap 20 is formed above both first and second regions 28, 30 of the plurality of markings 16 (with a third region 32 of the plurality of markings having second opacifying region 18*b* of first opacifying layer 18 located thereover). Gap 26 in the second opacifying layer 24 is located under the first region 28 of said plurality of markings 16. Second opacifying region 24*b* of second opacifying layer 24 extends under both the second and third regions 30, 32 of said plurality of markings 16.

As will be appreciated, the level of visibility of the various regions of the plurality of markings (with the second and third regions forming partially hidden and hidden portions respectively of the security feature) will differ due to the fact that there are no opacifying layers above/below the first region 28, there is only an opacifying layer below the second region 30, and there are opacifying layers both above and below the third region 32.

Figure 12A:
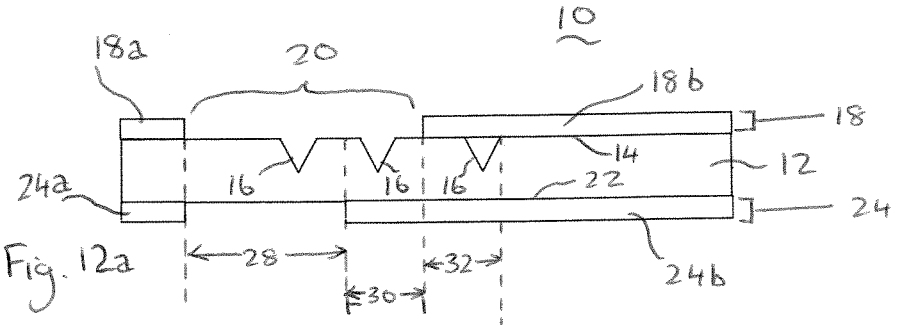
FIG. 12*a* illustrates a schematic side elevation of a security document marked with a security feature and having opacifying layers applied thereto in a twelfth embodiment.
Figure 12B:
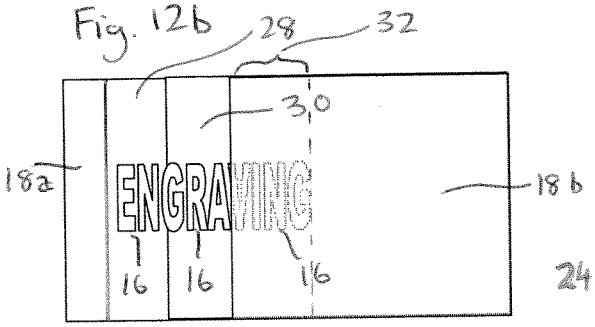
FIG. 12*b* illustrates a plan view of the security document of FIG. 12*a* when viewed in transmission.
Figure 12D:
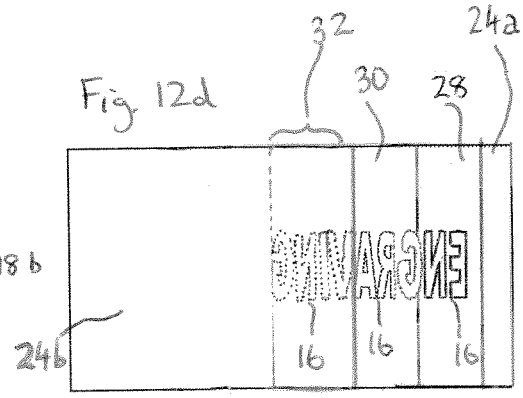
FIG. 12*d* illustrates a bottom view of the security document of FIG. 12*a* when viewed in transmission.
Figure 12C:
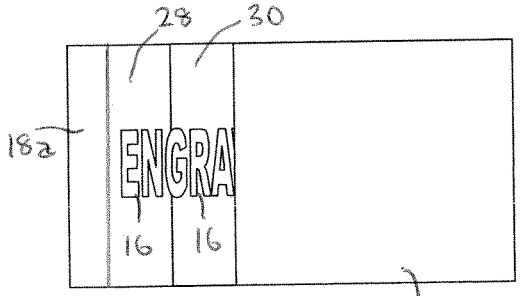
FIG. 12*c* illustrates a plan view of the security document of FIG. 12*a* when viewed in reflection.

FIGS. 12*b* and 12*c* illustrate top views of the security document 10 of FIG. 12*a* when viewed in transmission and reflection respectively. As will be appreciated, in transmission, there will be three levels of visibility of the security feature resulting from the differing levels of visibility of the three regions of the plurality of markings 16.

Figure 12E:
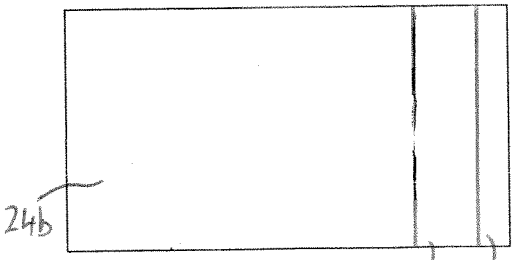
FIG. 12*e* illustrates a bottom view of the security document of FIG. 12*a* when viewed in reflection.

FIGS. 12*d* and 12*e* illustrate bottom views of the security document 10 of FIG. 12*a* when viewed in transmission and reflection respectively. Again, in transmission, there will be three levels of visibility of the security feature resulting from the differing levels of visibility of the three regions of the plurality of markings 16.

The proportions of the security feature that will be visible when the security document 10 is viewed in reflection will differ depending on the side of the note being observed (as will be appreciated from a comparison of FIGS. 12*c* and 12*e*). The full security feature, however, will only be visible when the security document is viewed in transmission.

Figure 13:
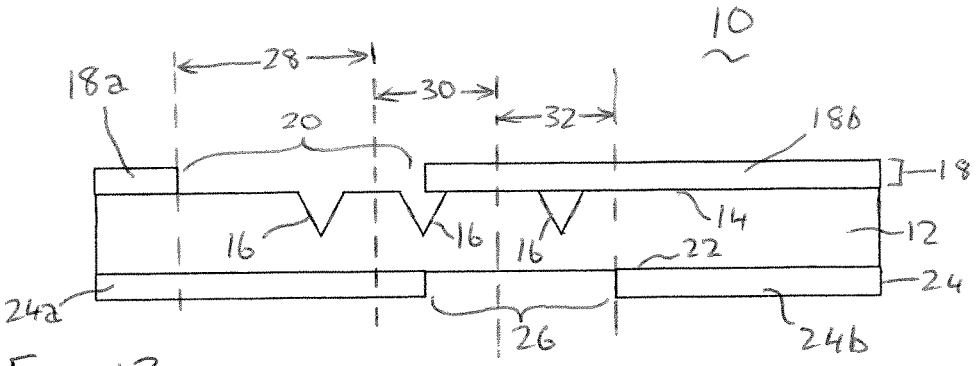
FIG. 13 illustrates a schematic side elevation of a security document marked with a security feature and having opacifying layers applied thereto in a thirteenth embodiment.

In FIG. 13, gap 20 in the first opacifying layer 18 is located above both a first region 28 of the plurality of markings 16 and part of a second region 30 of the plurality of markings. The other part of the second region 30 and the entire third region 32 of the plurality of markings has a second opacifying region 18*b* of first opacifying layer 18 located thereover. Gap 26 in the second opacifying layer 24 is located under both the said other part of the second region 30 and the entire third region 32 of said plurality of markings 16. First opacifying region 24*a* of second opacifying layer 24 extends under the first region 28 and the said part of the second region 30 of said plurality of markings 16.

FIG. 13 illustrates a "mismatched half-window" arrangement where, by mismatching the half-windows, the appearance of the security feature formed from the plurality of markings 16 will vary depending on which side the security document is viewed. Also, the full security feature formed from the plurality of markings 16 will only be visible in transmission.

Figure 14:
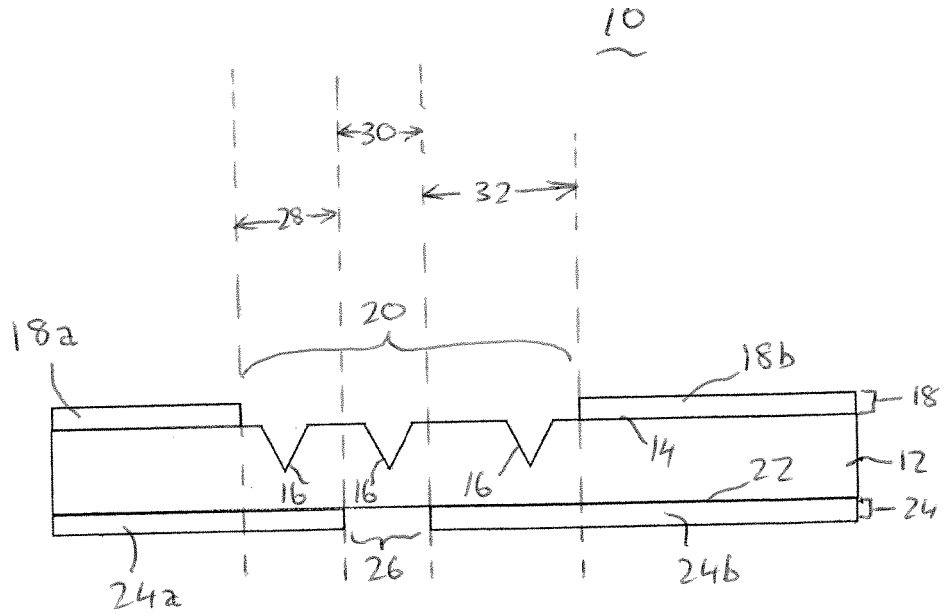
FIG. 14 illustrates a schematic side elevation of a security document marked with a security feature and having opacifying layers applied thereto in a fourteenth embodiment.

FIG. 14 illustrates an "asymmetric window" arrangement, where gap 20 in the first opacifying layer 18 is located above first, second and third regions 28, 30, 32 of the plurality of markings 16. Gap 26 in the second opacifying layer 24 is located under the second region 30. First opacifying region 24*a* of second opacifying layer 24 extends under the first region 28 and second opacifying region 24*b* of second opacifying layer 24 extends under the third region 32 of said plurality of markings 16.

In this arrangement, the proportion of the security feature which is visible on one side of the security document differs from the proportion which is visible on the other side. A whole security feature could be viewed in part from an opposing side, e.g. as a way of revealing a hidden pattern in the security feature or combining the sub-pattern in the security feature with a print design that differs from the full security feature pattern.

Figure 15:
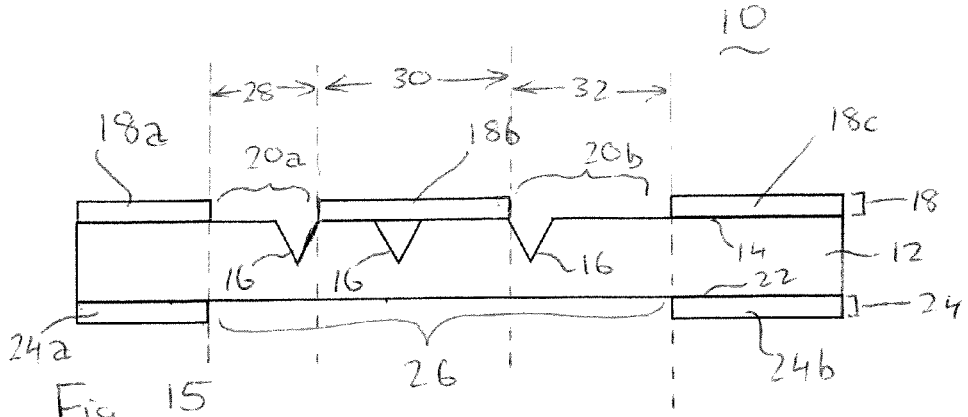
FIG. 15 illustrates a schematic side elevation of a security document marked with a security feature and having opacifying layers applied thereto in a fifteenth embodiment.

FIG. 15 illustrates a "half-hidden/half-window island" arrangement. A first opacifying layer 18 is formed with two gaps 20*a*, 20*b* therein, thereby separating the first opacifying layer 18 into three regions 18*a*, 18*b*, 18*c*. The first gap 20*a* in the first opacifying layer 18 is located above a first region 28 of the plurality of markings 16 and the second gap 20*b* in the first opacifying layer 18 is located above a third region 32 of the plurality of markings 16. A second region 18*b* of the first opacifying layer 18 is formed over a second region 30 of the plurality of markings 16. Gap 26 in the second opacifying layer 24 is located under the first, second and third regions 28, 30, 32 of the plurality of markings 16.

In this arrangement, a security feature can be partly obscured on one side of the security document by way of an opacified "island", i.e. second region 18*b* of the first opacifying layer 18 formed over the second region 30 of the plurality of markings 16. This could be used, as a way of differentiating both sides of the security document, or to integrate a variable appearance into a double-sided design (for example, as described in relation to FIG. 14).

Figure 16:
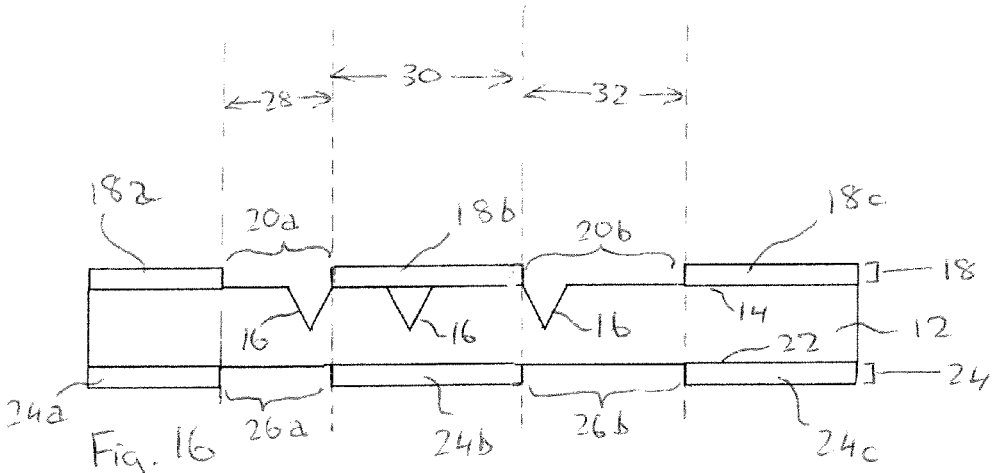
FIG. 16 illustrates a schematic side elevation of a security document marked with a security feature and having opacifying layers applied thereto in a sixteenth embodiment.

FIG. 16 illustrates a "half-hidden island" arrangement. A first opacifying layer 18 is formed with two gaps 20*a*, 20*b* therein, thereby separating the first opacifying layer 18 into three regions 18*a*, 18*b*, 18*c*. Similarly, a second opacifying layer 24 is formed with two gaps 26*a*, 26*b* therein, thereby separating the second opacifying layer 24 into three regions 24*a*, 24*b*, 24*c*. The first gap 20*a* in the first opacifying layer 18 is located above a first region 28 of the plurality of markings 16 and the second gap 20*b* in the first opacifying layer 18 is located above a third region 32 of the plurality of markings 16. Similarly, the first gap 26*a* in the second opacifying layer 24 is located under the first region 28 of the plurality of markings 16 and the second gap 26*b* in the second opacifying layer 24 is located under the third region 32 of the plurality of markings 16. A second region 18*b* of the first opacifying layer 18 is formed over a second region 30 of the plurality of markings 16, and similarly a second region 24*b* of the second opacifying layer 24 is formed under the second region 30 of the plurality of markings 16 and is located substantially directly opposite second region 18*b* of the first opacifying layer 18.

This arrangement modifies that illustrated in FIG. 15 by way of opacified "islands" over parts of the security feature on both sides of the security document. It will be appreciated that these islands can be asymmetric and that multiple islands on either/both sides can be applied. The above description refers to a security feature formed from a plurality of markings. However, in further arrangements of the above described embodiments, the security feature may be formed from a single marking.

As will be appreciated, etching/embossing and opacifying/printing the film results in a change in the transmissive properties of the film. By combining a watermark feature with the above described arrangements, the properties of the watermark feature could be enhanced. The security feature disclosed above may be not only readable by a human, but also may be readable by a machine. Such a feature would have applications in, for example, high speed central sorters which capture images in both reflection and transmission. A security feature as disclosed above would be readable by such high speed central sorters.

The invention claimed is:

1. A method of producing a security document, comprising:

providing a polymer film having first and second surfaces;

etching or embossing a security feature directly into a region of surface material of said polymer film at least in one of said first and second surfaces of said polymer film; and forming an opacifying layer on at least a portion of each of said first and second surfaces of said polymer film, wherein said etching or embossing step occurs prior to completion of said opacifying layer forming step, and wherein at least one of the opacifying layers is formed so that at least a portion of the opacifying layer is disposed over the security feature.

2. The method according to claim 1, wherein said etching or embossing step occurs during a slitting step of a film from a web, said film forming said polymer film.

3. The method according to claim 1, wherein at least one of the opacifying layers is formed so that at least a portion of the opacifying layer is not disposed over the security feature.

4. The method according to claim 1, wherein at least one of the opacifying layers is formed over an entire first and/or second surface of said polymer film.

5. The method according to claim 1, wherein at least one of the opacifying layers is formed with one or more gapped regions without opacifying material covering the polymer film, such that one or more portions of the polymer film in the one or more gapped regions form one or more windows providing direct, unobstructed viewing of the security feature.

6. The method according to claim 1, wherein said embossing of said security feature in said region of at least one of said first and second surfaces of said polymer film is performed by way of an ultrasonic embossing process.

7. The method according to claim 1, wherein said etching of said security feature in said region of at least one of said first and second surfaces of said polymer film is performed by way of a laser etching process.

8. The method according to claim 1, wherein at least one of the opacifying layers comprises at least one of: an actual opacifying layer; and/or offset, screen printed, coloured gravure and/or foil patches.

9. A method according to claim 1, wherein said polymer film is transparent.

10. The method according to claim 1, wherein said polymer film is a biaxially oriented propylene polymer (BOPP) film.

11. A security document, comprising:

a polymer film having first and second surfaces;

a security feature etched or embossed directly into a region of surface material of said polymer film at least in one of said first and second surfaces of said polymer film; and an opacifying layer formed on at least a portion of each of said first and second surfaces of said polymer film, wherein said security feature is etched or embossed directly into surface material of said polymer film prior to completion of said opacifying layer, and wherein at least one of the opacifying layers is formed so that at least a portion of the opacifying layer is disposed over the security feature.

12. The security document according to claim 11, wherein said security feature is etched or embossed during a slitting step of a film from a web, said film forming said polymer film.

13. The security document according to claim 11, wherein at least a portion of an opacifying layer is not disposed over the security feature.

14. The security document according to claim 11, wherein at least one of the opacifying layers is formed over an entire first and/or second surface of said polymer film.

15. The security document according to claim 11, wherein at least one of the opacifying layers comprises one or more gapped regions without opacifying material covering the polymer film, and wherein one or more portions of the polymer film in the one or more gapped regions form one or more windows providing direct, unobstructed viewing of the security feature.

16. The security document according to claim 11, wherein said embossing of said security feature in said region of at least one of said first and second surfaces of said polymer film is performed by way of an ultrasonic embossing process.

17. The security document according to claim 11, wherein said etching of said security feature in said region of at least one of said first and second surfaces of said polymer film is performed by way of a laser etching process.

18. The security document according to claim 11, wherein at least one of the opacifying layers comprises at least one of: an actual opacifying layer; and/or offset, screen printed, coloured gravure and/or foil patches.

19. The security document according to claim 11, wherein said polymer film is transparent.

20. The security document according to claim 11, wherein said polymer film is a biaxially oriented propylene polymer (BOPP) film.

21. The security document according to claim 11, wherein said security feature is at least one of: machine readable; and human readable.

22. A bank note comprising a security document according to claim 11.

23. The method according to claim 1, wherein the security feature is etched directly into the region of surface material of said polymer film.

24. The security document according to claim 11, wherein the security feature is etched directly into the region of surface material of said polymer film.

25. A method of producing a security document, comprising:

providing a transparent polymer film having first and second surfaces;

etching or embossing a security feature directly into a region of surface material of said transparent polymer film; and forming an opacifying layer on at least a portion of at least one of said first and second surfaces of said transparent polymer film, wherein said etching or embossing step occurs prior to completion of said opacifying layer forming step.

26. A security document, comprising:

a transparent polymer film having first and second surfaces;

a security feature etched or embossed directly into a region of surface material of said transparent polymer film at least in one of said first and second surfaces; and an opacifying layer formed on at least a portion of at least one of said first and second surfaces of said transparent polymer film, wherein said security feature is etched or embossed directly into surface material of said transparent polymer film prior to completion of said opacifying layer.

* * * * *